United States Patent [19]

Eiermann

[11] 4,149,834

[45] Apr. 17, 1979

[54] DELIVERY VALVE, ESPECIALLY FOR ROTARY PISTON COMPRESSORS

[75] Inventor: Dankwart Eiermann, Lindau, Fed. Rep. of Germany

[73] Assignees: Borsig GmbH; Wankel GmbH, both of Berlin, Fed. Rep. of Germany

[21] Appl. No.: 867,769

[22] Filed: Jan. 9, 1978

[30] Foreign Application Priority Data

Jan. 7, 1977 [DE] Fed. Rep. of Germany ..... 2700521

[51] Int. Cl.[2] ..... F01C 21/12; F04C 29/08; F16K 15/14

[52] U.S. Cl. ..... 418/15; 418/270; 137/512.15

[58] Field of Search ..... 418/15, 270; 137/512.15; 417/454

[56] References Cited

U.S. PATENT DOCUMENTS

| | | | |
|---|---|---|---|
| 209,525 | 10/1878 | Tonkin | 137/512.15 |
| 3,809,511 | 5/1974 | Linder et al. | 418/270 |
| 3,811,468 | 5/1974 | Bellmer | 137/512.15 |
| 4,088,428 | 5/1978 | Bannister et al. | 418/270 |

*Primary Examiner*—John J. Vrablik

*Attorney, Agent, or Firm*—Walter Becker

[57] ABSTRACT

A delivery valve, especially for a rotary piston compressor, which valve is adapted to be inserted into an opening provided in the compressor housing and extending substantially parallel to the axis of the compressor housing. The compressor housing has a bore in which is fitted a sleeve which has tangentially directed valve slots and forms a valve seat. The sleeve surrounds a member which over its entire length has an approximately horseshoe shape. That portion of the horseshoe shaped part which is located opposite the open side thereof faces toward the valve slots and has a greater bending radius than the sleeve. The free ends of the horseshoe shaped part which define the open side of the horseshoe shaped part are bent back toward the outside of this part while the lateral flanks of the horseshoe part bear against the sleeve. The flanks of the horseshoe shaped part have tangentially directed lateral perforations in which are guided parallel strip-shaped cutouts or tongues of a resilient sheet metal the marginal portions of which are clamped into the bent back portions of the horseshoe shaped part, the arrangement being such that the cutouts bear against the sleeve in front of the valve slots when the valve is closed.

7 Claims, 6 Drawing Figures

DELIVERY VALVE, ESPECIALLY FOR ROTARY PISTON COMPRESSORS

This invention relates to a delivery valve for a rotary piston compressor in which the valve is adapted to be inserted into an opening extending parallel to the axis of the peripheral housing of the compressor.

Such valves control the delivery of the medium from the compression working chamber. They are closed by the pressure of the compressed medium already delivered and they only open when the counter-pressure of this medium is attained or exceeded by the rising pressure in the working chamber.

Such a valve should meet the following requirements:

1. The valve seat should be disposed as close as possible to the inner wall of the housing in order to keep the dead space at the inlet to the valve as small as possible.

2. The valve should be disposed in a peripheral outlet in the outer wall of the housing in order to avoid the flow losses which would result from it being put in a side wall.

3. The valve opening should extend over the whole width of the running surface in order to achieve favourable flow characteristics.

4. There should be the least possible weakening of the peripheral wall of the housing by the opening needed for the valve and the minimum of hindrance to the cooling of the housing by the pressure of the valve.

5. The valve should be easy to get at and to assemble.

In Swiss Patent Specification No. 181 039 there is described a valve for a compressor of the vane type with an arcuate peripheral running surface, the valve being inserted laterally into a relatively large bore in the peripheral wall of the housing, parallel to the axis. It is true that this construction does fulfil requirements 2 and 3 above, but since the valve seating lies near the plane of the axial center of the bore, a large dead space results. As a consequence of the size of the bore the housing is weakened in exactly that region where the pressure is highest and there is a restriction of the space available for the cooling fins near the working chamber in the region of greatest thermal load. Moreover this valve can only be mounted or removed if at least one side wall of the machine is removed, which signifies such a substantial outlay that the above-mentioned important requirement 5 is not met.

In German Offenlegenschrifts Nos. 2 002 076 and 2 403 775 there are proposed valves which likewise are inserted laterally into openings in the peripheral wall of the housing, with their axes parallel to that of the machine. Here the formation of a dead space is, it is true, avoided as far as possible and a large valve cross-section is possible, favorable from the flow aspect. However the fact that the plane of the valve seating lies very close to the running surface of the peripheral wall results in weakening of that wall. Moreover, as is true also with the structure in the above-mentioned Swiss patent specification, it is only possible to mount this valve with the side wall removed, which generally cannot be done without dismantling the compressor itself.

Such known valves are reed valves or plate valves, which are generally not suited, over a long period of time, to the high vibration loading and rapid movements in rotating compressors running at more than 3,000 r.p.m. In the event of the reeds or plates breaking, broken parts falling into the working chambers of the compressor can lead to serious damage to the compressor system. Above all in the event of the valve reeds striking the cage, the so-called whip effect arises, leading to such high acceleration that parts of the reeds are torn off. The chief drawback in such valves is that the significant bending of the reeds or plates is confined to relatively small portions near the attachment point and cannot be distributed over the entire length, which is far from large, of the reed or plate, and so failure through fatigue can occur.

It is an object of the present invention to provide a delivery valve which substantially overcomes the disadvantages of the known valves and which substantially achieves all the above mentioned requirements.

According to the present invention we provide a delivery valve for a rotary piston compressor in which the valve is adapted to be inserted in an opening extending parallel to the axis of the peripheral housing of the compressor the valve comprising a sleeve forming a valve seating with tangentially directed valve slots which is adapted to be fitted in a bore in the peripheral wall of the compressor, a first component of Ω shape over its entire length received within the sleeve, the closed side of the first component facing the valve slots and having a larger radius of curvature than the sleeve, the bentback flanges and the lateral flanks of the first component engaging against the sleeve and the first component having in its flanks tangentially directed rectangular lateral openings in which are guided parallel strip-shaped portions of a second component comprising a resilient sheet metal plate of which the edges are located in the flanges of the Ω-shaped component, the arrangement being such that in use the parallel strip-shaped portions engage the sleeve in front of the valve slots when the valve is closed.

The valve can be inserted into the housing of the compressor from outside without difficulty and can be secured in place from the outside so that the valve can easily be exchanged in the event of damage. Moreover, by virtue of the simple interengagement of the individual components of the valve, the valve is easy to assemble. The manufacture of the individual components requires no special fabrication techniques.

By virtue of the valve seating having a surface of arcuate curved shape the opening in the peripheral wall caused by the bore that receives the valve can be smaller, resulting in improved strength of the peripheral wall of the housing and move favorable cooling conditions.

The invention will now be described in more detail, by way of example only, with reference to the accompanying drawings, in which.

Figure 1:
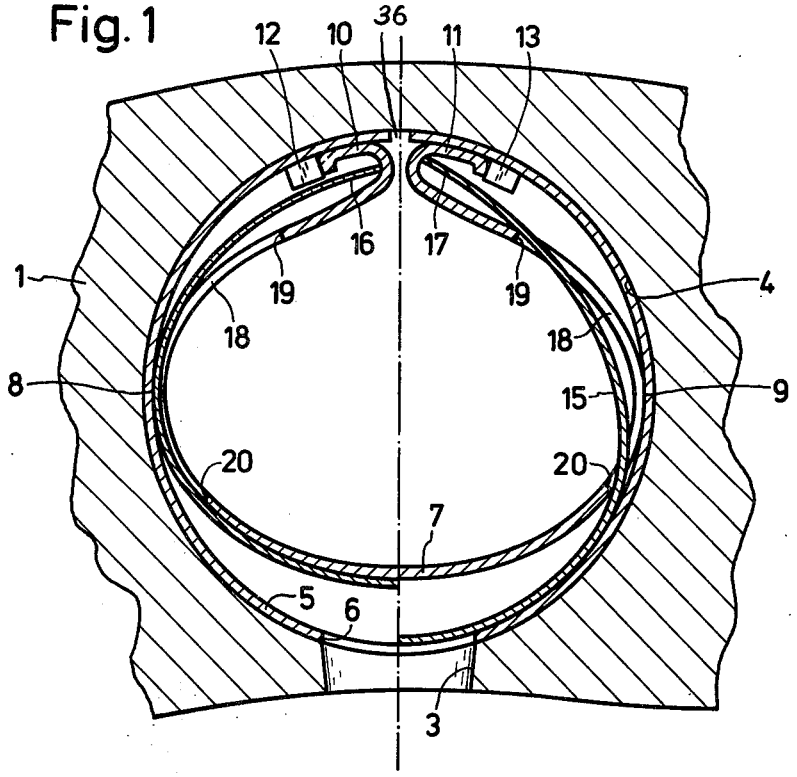
FIG. 1 is a radial section through a valve according to the invention taken in the plane I—I in FIG. 2, the left-hand half of the figure showing the valve open and the righthand half showing it closed. It is to be understood that each half should be completed symmetrically for the corresponding condition of the valve.
Figure 2:
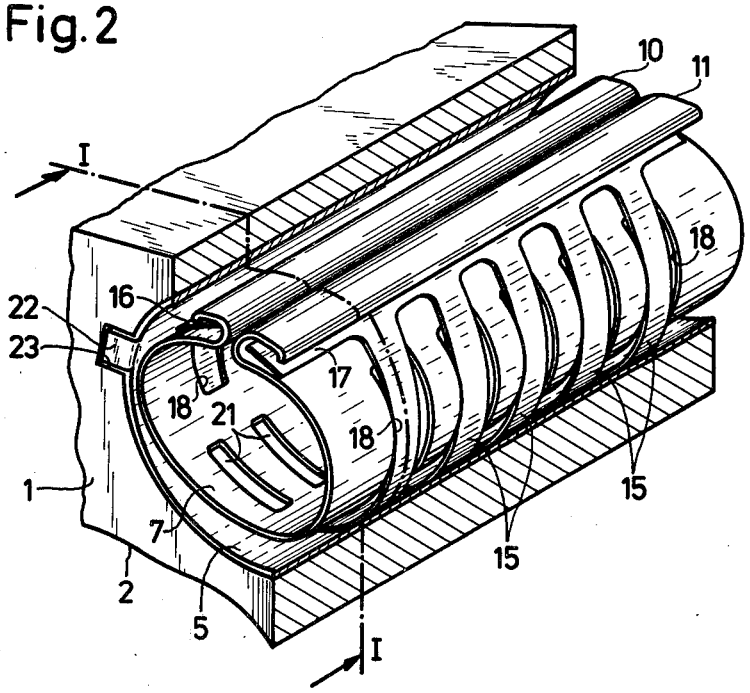
FIG. 2 is a perspective view of the same valve, partially broken away.
Figure 5:
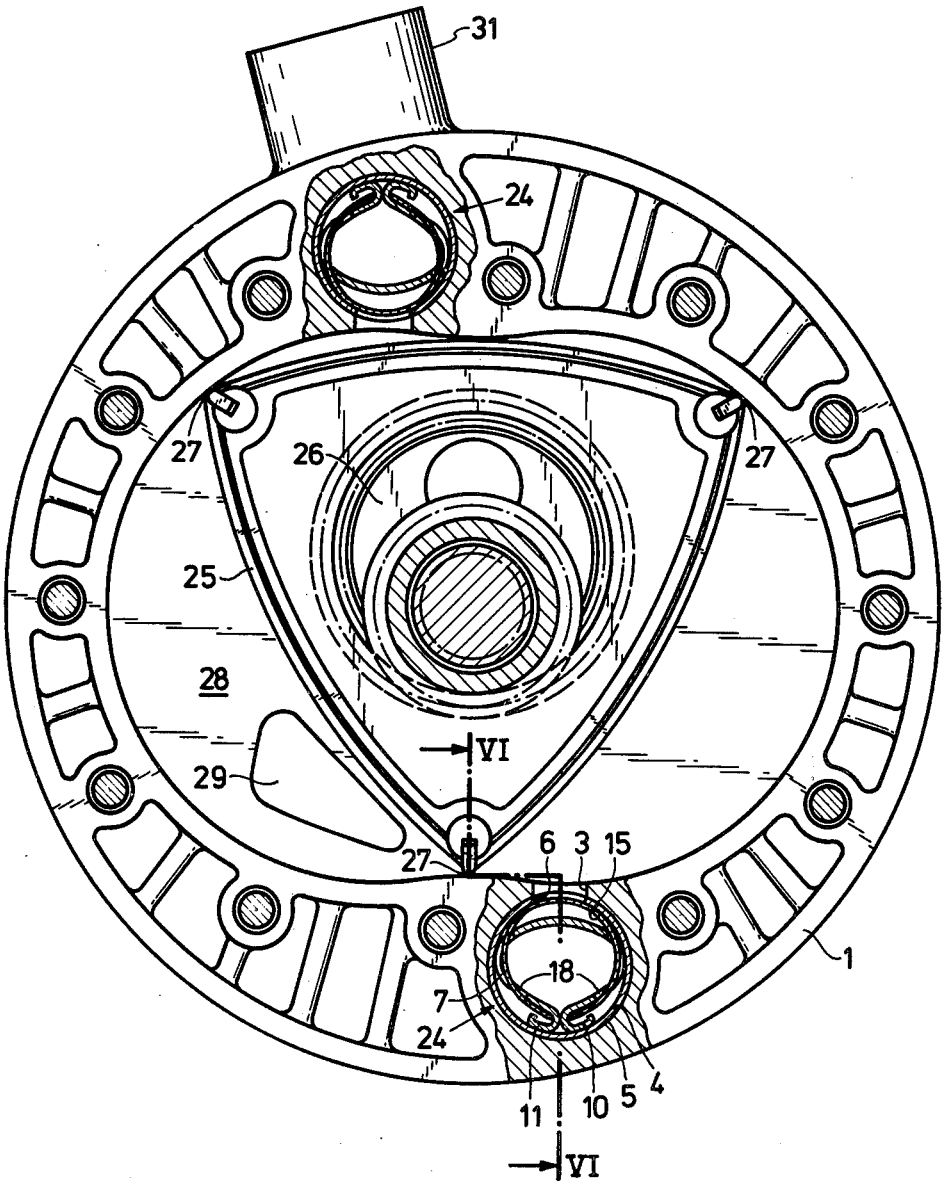
FIG. 5 is a radial section through a Wankel-type rotary piston compressor with valves according to the invention.
Figure 6:
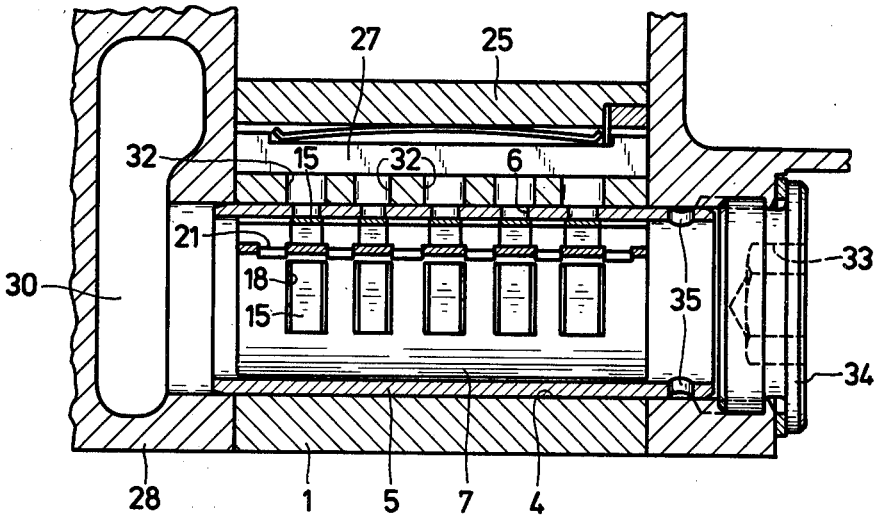
FIG. 6 is a section through the rotary piston compressor of FIG. 5, taken in the plane VI—VI.

The valve illustrated in FIGS. 1 and 2 is shown mounted in the peripheral wall 1 of the housing of a rotary piston compressor, for example the compressor shown in FIGS. 5 and 6, and extends in a direction parallel to the axis of the compressor. The compressor has a trochoidal peripheral running surface 2. A delivery opening 3 provided in the peripheral wall 1 leads into a bore 4 which extends right through the peripheral wall 1 in a direction parallel to the axis of the machine. The bore 4 leads to the delivery connections of the machine at one or both ends.

The valve is inserted in the bore 4 and includes an accurately fitting sleeve 5 provided with valve slots 6 on that side of the sleeve 5 which faces towards the delivery opening 3, and which extend over the whole breadth of the wall 1. The sleeve 5 forms the valve seating in the region of the slots 6. The sleeve can be split 36 along part or all of its length and engages resiliently against the wall of the bore 4.

Figure 3:
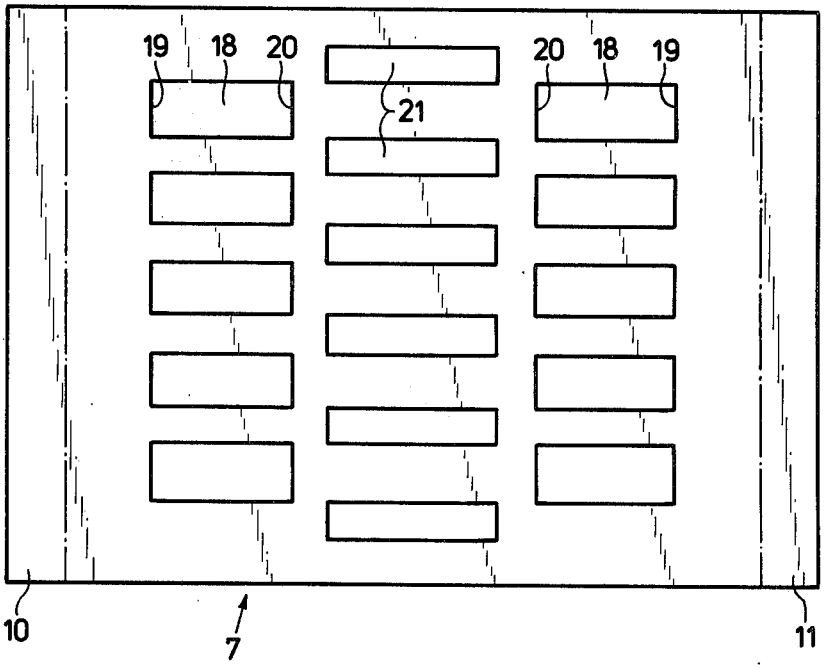
FIG. 3 is a developed plan view of the Ω-shaped component rolled out flat.

Inserted in the sleeve 5 is a component 7 which is of Ω shape in radial cross-section and forms the valve cage, the component 7 permanently and resiliently engages the sleeve 5 at its flanks 8 and 9 and with its folded-back flanges 10 and 11. To prevent the component 7 from distortions the sleeve 5 has inwardly bent tongues 12 and 13 which place themselves in front of the flanges 10 and 11. The closing side of the component 7 points towards the valve seating. In this region the component 7 has a larger radius of curvature than the sleeve 5 and forms the valve cage. The component 7 is provided with rectangular lateral openings 18 in its flanks 8 and 9 and with rectangular openings 21 which are in positions offset relative to the openings 18. The openings 18 and 21 are shown in FIG. 3 projected into one plane and their function is described further below.

Figure 4:
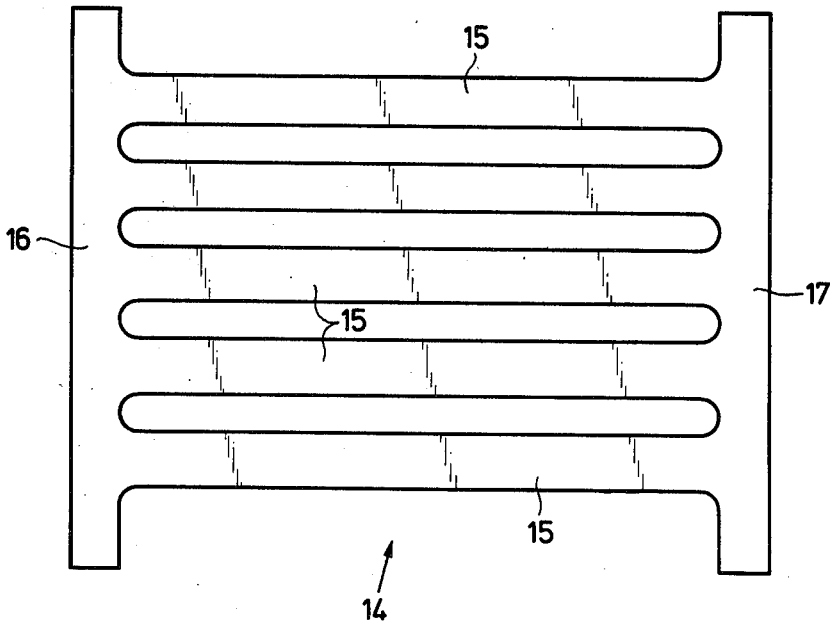
FIG. 4 is a developed plan view of the sheet metal plate rolled out flat.

Embracing the component 7 is a sheet metal plate 14 which is bent round the component 7 and engages the sleeve 5 in the region of the valve slots 6 when the valve is closed. The sheet metal plate 14 is stamped out in the manner illustrated in FIG. 4 so that it forms very long narrow valve tongues or reeds which are arranged spaced apart from one another by a distance which, for example, is from a third to half the width of the reeds themselves. The edges 16 and 17 of the plate 14 which extend into the flanges 10 and 11 of the component 7 connect the ends of the reeds 15 together and are equal in length to the sleeve 5 so that on assembly of the valve the edges 16,17 determine the positions of the reeds 15.

The openings 18 in the component 7 are equal in number to the valve reeds 15, and their spacing corresponds to the stamped-out intermediate spaces between the reeds 15 in the sheet metal plate 14. The central openings 21 in the component 7 have substantially the width of the space between the reeds 15 (FIGS. 3 and 6).

The openings 18 are wider than the reeds 15 and form guides for the reeds 15. When the edges 16,17 of the sheet metal plate 14 are located in the flanges 10,11 of the component 7 the reeds 15 engage in the openings 18 with a small amount of play. The openings are sufficiently long that the reeds 15 extend through the openings and are free from the upper edges 19 to the lower edges 20 of the openings. The sheet metal plate 14 is basically flat so that, on clamping the edges 16,17 in the flanges 10,11 the resilience of the plate results in the reeds having a generally flat curvature in the region of the openings 18 in the flanks of the component 7 and a rounded curvature corresponding to the curvature of the sleeve 5 in the region of the valve slots 6 so that the reeds 15 press against the sleeve 5 to close the valve slots 6.

In the condition described above the valve is closed, in that the reeds 15, under their own spring force combined with the excess pressure in the pressure chamber, press against the sleeve 5 in the region of the valve slots 6 and thereby close the latter, as illustrated on the right-hand side of FIG. 1. It will be understood that the slots 6 are smaller than the reeds 15.

As a result of excess pressure in the working chamber of the compressor which exceeds the spring force of the reeds and the pressure in the valve itself, the reeds 15 are lifted away from the valve slots and thereby open the latter, as shown on the left-hand side of FIG. 1. The reeds are pressed against the rounded part on the component 7 and yield resiliently over their whole lengths so as to bend away in the region of the flanks of the component 7 towards the sleeve 5.

When the valve is open, the reeds lie between the central openings 21 in the component 7. The openings 21 allow the gases under pressure, to enter the valve through the open slots 6 in the sleeve 5, to pass into the interior of the component 7 so as to be conducted away axially within the component 7. Such axial flow of the gases takes place equally in the space between the sleeve 5 and the component 7.

The advantage of this construction is that the valve reeds have a substantial length over which they are freely movable and over which they are able to distribute uniformly the bending loads which arise in their opening and closing movements. Accordingly, as can be seen from FIG. 1, individual elements experience only small bending stress in comparison with the known valve tongues or reeds. The deformation arising in the valve movement thus comprises only a slight increase in the curvature of the side parts of the reeds over their whole extent.

A further advantage arises from the fact that the sheet metal plate 14 is not secured at its edges 16 and 17 by screws, as are other known valve reeds or plates. It is therefore possible to avoid the marked deformation that would otherwise arise directly on the clamping points by allowing the edges that engage in the flanges 10 and 11 to move freely. As shown in FIG. 1, the plate 14 forms a large angle with the central axis, shown in broken lines, when the valve is open than when it is closed. In this way it is possible to avoid the fatigue fractures which markedly reduce the working life of known valves.

The closing of the valve occurs through uniform engagement, almost simultaneously over all regions, of the reeds against the lower curved part of the sleeve 5 on large surfaces so that also here again, as on opening, there is a wide distribution of the engaging load.

Tests have shown that the valves according to the invention are subject to no wear, fatigue or fractures of the reeds even after long operational use, such as would otherwise have been expected long before in valves with normal reeds or plates.

The valve according to the invention is assembled and inserted in the following manner: The sheet metal plate 14 is bent around the component 7 and the edges 16,17 fitted into the bent-back flanges 10,11 of the component 7. Then both components 7 and 14 are inserted in the sleeve 5, the component 7 being secured in position by the bent-in tongues 12 and 13 of the sleeve 5. The resulting valve, produced solely by stamping and bending and assembling together, can be slid into the bore 4 in the peripheral wall 1 of the housing through a further bore aligned with it in a side portion of the compressor, and connected to a delivery connection. The valve can be secured against rotation by an outwardly bent lug or tab 22 on the sleeve 5, engaging in a recess 23 in the peripheral wall 1 of the compressor.

The compressor illustrated in FIGS. 5 and 6 is a 2:3 ratio Wankel-type rotary piston compressor with a three-cornered piston 25 rotatable on an eccentric 26 and provided at its apeces with seals 27 which engage the trochoidal peripheral running surface 2 of the peripheral wall 1 of the housing. Inlet ports 29 are provided in the side walls 28 of the housing. Two valves 24 of the type described above are inserted in respective bores 4 formed in the peripheral wall. The bores 4 lead to a delivery chamber 30 in a side wall 28 which leads from the two valves 24 to the delivery connections 31. Outlet ports comprising slots 32 are provided in the peripheral running surface 2. The slots 32 extend in the direction of rotation of the piston 25 and lie opposite the slots 6 in the sleeve 5. Each valve 24 is retained in the associated bore 4 by a screwed cover 34 provided with a hexagon socket 33. Holes 35 provided in the sleeve of each valve allow the valves to be withdrawn from the associated bore 4.

Within the scope of the invention it is possible for the valve according to the invention to be employed for other purposes than as a delivery valve for a compressor. It is true that it is of particular advantage for compressors as its use makes it possible to ensure that parts of the reeds or plates cannot fall into the working chambers of the compressor and destroy sealing components inside.

A further advantage is its long working life which equals that of the compressor, and the fact that it is particularly simple to manufacture.

It is, of course, to be understood that the present invention is by no means limited to the specific showing in the drawing, but also comprises any modifications within the scope of the appended claims.

What I claim is:

1. For use in connection with a rotary piston compressor having a recess in its peripheral wall and also having an opening in the peripheral housing portion of said compressor and extending substantially parallel to the axis of said peripheral housing portion, a delivery valve, which includes: a curved sleeve forming a valve seat and provided with tangentially directed valve slots, said sleeve being adapted to be fitted into said opening, a first component having a horseshoe shaped cross section and over its entire length being received within said sleeve, said first component having a closed side facing said valve slots and having a larger radius of curvature than said sleeve, said first component also having outwardly bent back flanges and lateral flanks, both said flanges and said flanks bearing against said sleeve, said first component having in its flanks tangentially directed rectangular lateral openings, and a second component comprising a resilient sheet metal plate having cutout portions and parallel strip-shaped portions guided in said rectangular lateral openings, the marginal portions of said sheet metal plate being located in said flanges of said first component, the arrangement being such that in use said parallel strip-shaped portions engage said sleeve and cover said slots when the valve is closed.

2. A delivery valve according to claim 1, in which said first component has further central openings in said closed side, said central openings being offset with respect to said lateral openings.

3. A delivery valve according to claim 1, in which said sleeve has at its marginal portions inwardly bent tongues facing the ends of the bent-back flanges of said first component to secure said first component in position.

4. A delivery valve according to claim 1, in which said sleeve has at one of its marginal portions an outwardly bent lug adapted to engage in said recess in the peripheral wall of the compressor to secure the valve against rotation relative to the opening.

5. A delivery valve according to claim 1, wherein the sleeve is longitudinally split and spring-urged outwards.

6. A delivery valve according to claim 1, wherein the valve is adapted to be retained in position in the opening by a screwed cover.

7. A delivery valve according to claim 1, wherein the first component is a stamped and curved metal sheet.

* * * * *